United States Patent [19]

Ficken

[11] Patent Number: 4,930,663

[45] Date of Patent: Jun. 5, 1990

[54] ARTICLE ALIGNMENT UNIT

[75] Inventor: Leonard A. Ficken, St. Louis County, Mo.

[73] Assignee: Unidynamics Corporation, New York, N.Y.

[21] Appl. No.: 258,848

[22] Filed: Oct. 17, 1988

[51] Int. Cl.[5] ..... G07F 11/36

[52] U.S. Cl. ..... 221/75; 221/242

[58] Field of Search ..... 221/75, 241, 242

[56] References Cited

U.S. PATENT DOCUMENTS

| | | | |
|---|---|---|---|
| 4,061,245 | 3/1976 | Lotspeich | 221/75 |
| 4,240,563 | 12/1980 | Lennartson | 221/75 |
| 4,258,860 | 5/1979 | Boettcher | 221/75 |
| 4,312,460 | 4/1980 | Boettcher | 221/75 |
| 4,369,896 | 3/1981 | Boettcher | 221/75 |
| 4,385,713 | 3/1981 | Boettcher | 221/75 |

*Primary Examiner*—F. J. Bartuska

*Attorney, Agent, or Firm*—Senniger, Powers, Leavitt and Roedel

[57] ABSTRACT

An article alignment unit adapted for use in a helix-type vending machine. The vending machine comprises a cabinet having a tray within the cabinet carrying at least two dispensing helices extending side-by-side from rear to front of the cabinet. Each helix is selectively driven for advancing articles to be dispensed placed on the tray between convolutions of the helix. A generally vertical central partition between the two helices has a top edge margin extending substantially the length of the helices, and first and second generally vertical outer partitions on opposite sides of the two helices. First and second article compartments are defined between the central partition and the first and second outer partitions, respectively, and each compartment contains one of the helices. The article alignment unit comprises a first elongate guide member adapted for pivoting about an axis parallel with and adjacent to the top edge margin of the central partition. The first member defines a guide surface which is varyingly positionable by pivoting the first guide member about the pivot axis from a generally vertical position adjacent the central partition to a position extending toward the first outer partition and above the helix of the first compartment for restricting lateral movement of articles within the first compartment.

11 Claims, 4 Drawing Sheets

ARTICLE ALIGNMENT UNIT

BACKGROUND OF THE INVENTION

This invention relates to an article alignment unit adapted for use in a vending machine and, in particular to such units adapted for use in a helix-type vending machine.

A helix-type vending machine generally comprises a cabinet having a window at its front and a plurality of trays or shelves in the cabinet each carrying a plurality of helices extending side-by-side therein from rear to front. Each helix is selectively driven within an article compartment for advancing articles to be dispensed placed on the tray between convolutions of the helix. The article compartments within the vending machine generally have the same dimensions. A problem associated with such vending machines is that of accommodating packages or products of different widths within the compartments.

It is known to implement a rotatable plate or bar within each helix for varying the effective width of the article compartment. Articles of product to be dispensed are placed between the plate and a sidewall of the compartment. Rotating the plate within the helix varies the distance between the plate and sidewall to thereby vary the effective width of the compartment. A problem associated with such devices is they limit the maximum effective width of the compartments. Since the plate is located within the helix, the maximum effective width is less than the width of the helix. Thus, the compartment cannot accommodate product larger (or wider) than the helix. Another problem with such devices is they are generally not easy to remove from the article compartment. Additionally, one such device has been needed for each compartment desired to be varied.

SUMMARY OF THE INVENTION

Among the objects of the present invention is the provision of an article alignment unit for a helix-type vending machine which varies the effective width of an article compartment for restricting lateral movement of articles within the compartment; the provision of such an alignment unit which maximizes the range of widths of articles which can be dispensed by the vending machine; the provision of such an alignment unit which simultaneously varies the effective width of two adjacent article compartments; the provision of such an alignment unit which is releasably attached to the vending machine; the provision of such a device that is of simple and inexpensive construction; and the provision of such a device that is compact.

Generally the article alignment unit of the present invention is adapted for use in a helix-type vending machine. The vending machine comprises a cabinet having a rear and front and at least one tray within the cabinet carrying at least two dispensing helices extending side-by-side from rear to front of the cabinet. Each helix is selectively driven for advancing articles to be dispensed placed on the tray between convolutions of the helix. A generally vertical central partition between the two helices has a top edge margin extending substantially the length of the helices, and first and second generally vertical outer partitions on opposite sides of the two helices. First and second article compartments are defined between the central partition and the first and second outer partitions, respectively, and each compartment contains one of the helices. The article alignment unit comprises a first elongate guide member adapted for pivoting about an axis parallel with and adjacent to the top edge margin of the central partition. The first guide member defines a first guide surface which is varyingly positionable by pivoting the first guide member about the pivot axis from a generally vertical position adjacent the central partition to a position extending toward the first outer partition and above the helix of the first compartment for restricting lateral movement of articles extending above the helix within the first compartment.

The article alignment unit also includes a second guide member adapted for pivoting about the pivot axis of the first guide member and means for releasably attaching the alignment unit to the central partition. The second guide member defines a second guide surface which is varyingly positionable within the second compartment by pivoting the second guide member about the pivot axis from a generally vertical position adjacent the central partition to a position extending toward the second outer partition and above the helix in the second compartment for restricting lateral movement of articles extending above the helix within the second compartment.

Thus, the alignment unit varies the effective width of an article compartment for restricting lateral movement of articles within the compartment. Since the guide members take up little room and are out of the way when pivoted to their vertical positions adjacent the central partition, articles wider than the helices can be dispensed by the vending machine and the range of widths of articles is maximized. Also, the two guide members permit a user to simultaneously vary the effective width of two adjacent article compartments with a single alignment unit. Further, since the alignment unit is releasably attached to the central partition, it can be removed from that partition and attached to another partition within the vending machine to vary the effective widths of two other compartments. The article alignment unit is thus compact and of simple and inexpensive construction.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
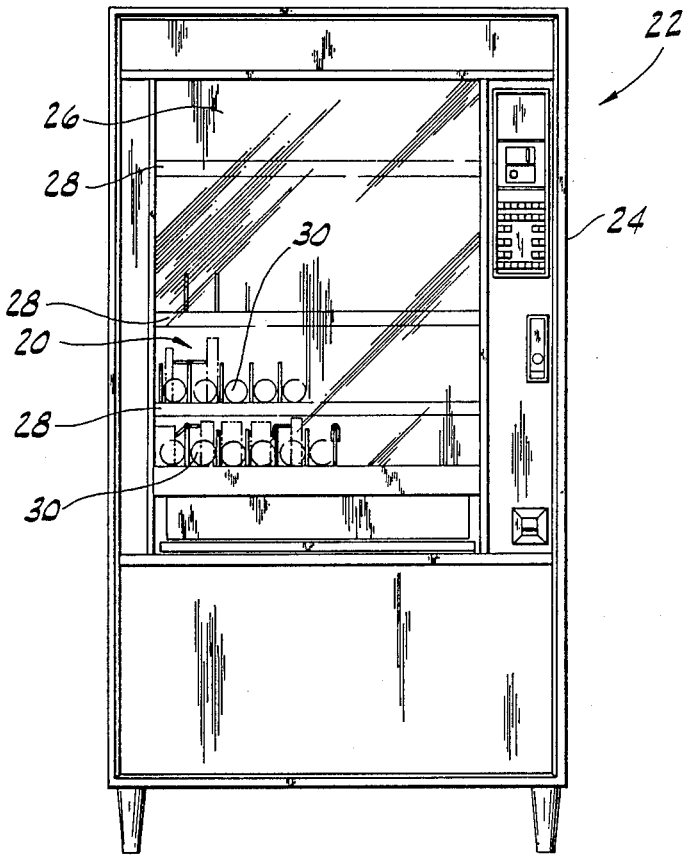
FIG. 1 is a front elevation view of a helix-type vending machine incorporating article alignment units of the present invention.

An article alignment unit for a helix-type vending machine constructed according to the principles of this invention is indicated generally as 20 in FIGS. 1–4. In general, the alignment unit 20 restricts lateral movement of articles of product contained within a vending machine. FIG. 1 shows the unit 20 within a machine 22. The vending machine 22 is not shown in detail since it is quite well known in the art. It will suffice to say that it generally comprises a cabinet 24 having a window 26 at the front and a plurality of shelves or trays 28 in the cabinet each carrying a plurality of dispensing helices 30 extending side-by-side therein from rear to front. Each helix 30 is selectively driven by, for example, an electric motor (not shown) for advancing articles to be dispensed placed on the tray 28 between convolutions of the helix, the forward article dropping off the forward end 28*a* of the tray 28.

Figure 2:
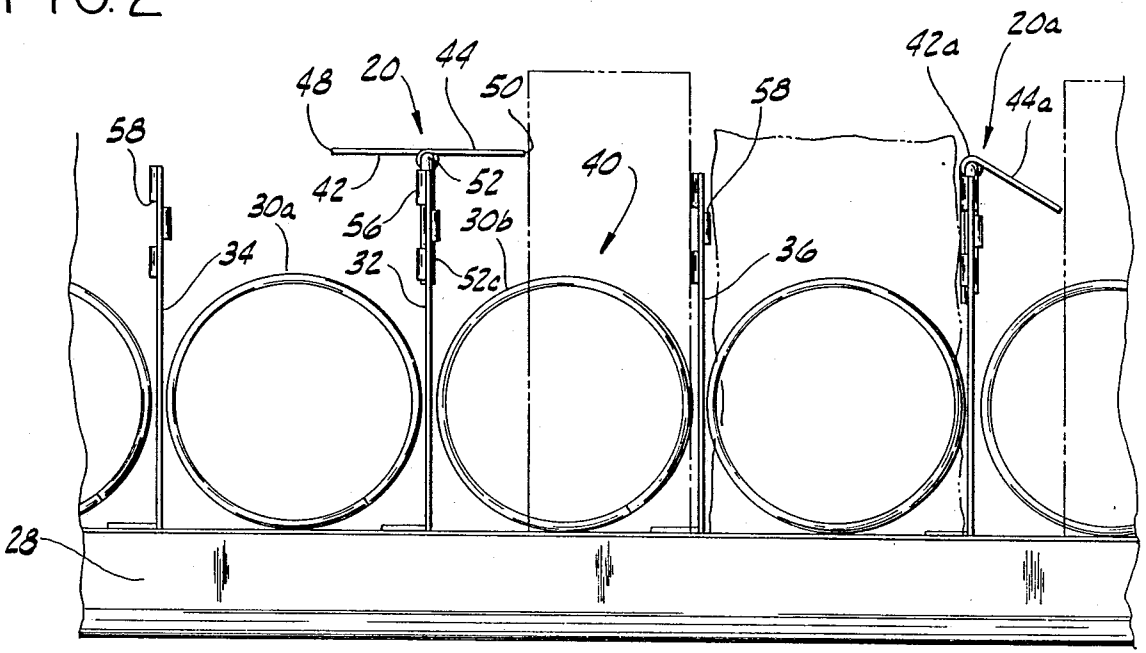
FIG. 2 is an enlarged front elevation view of the article alignment units connected to partitions between adjacent helices.
Figure 3:
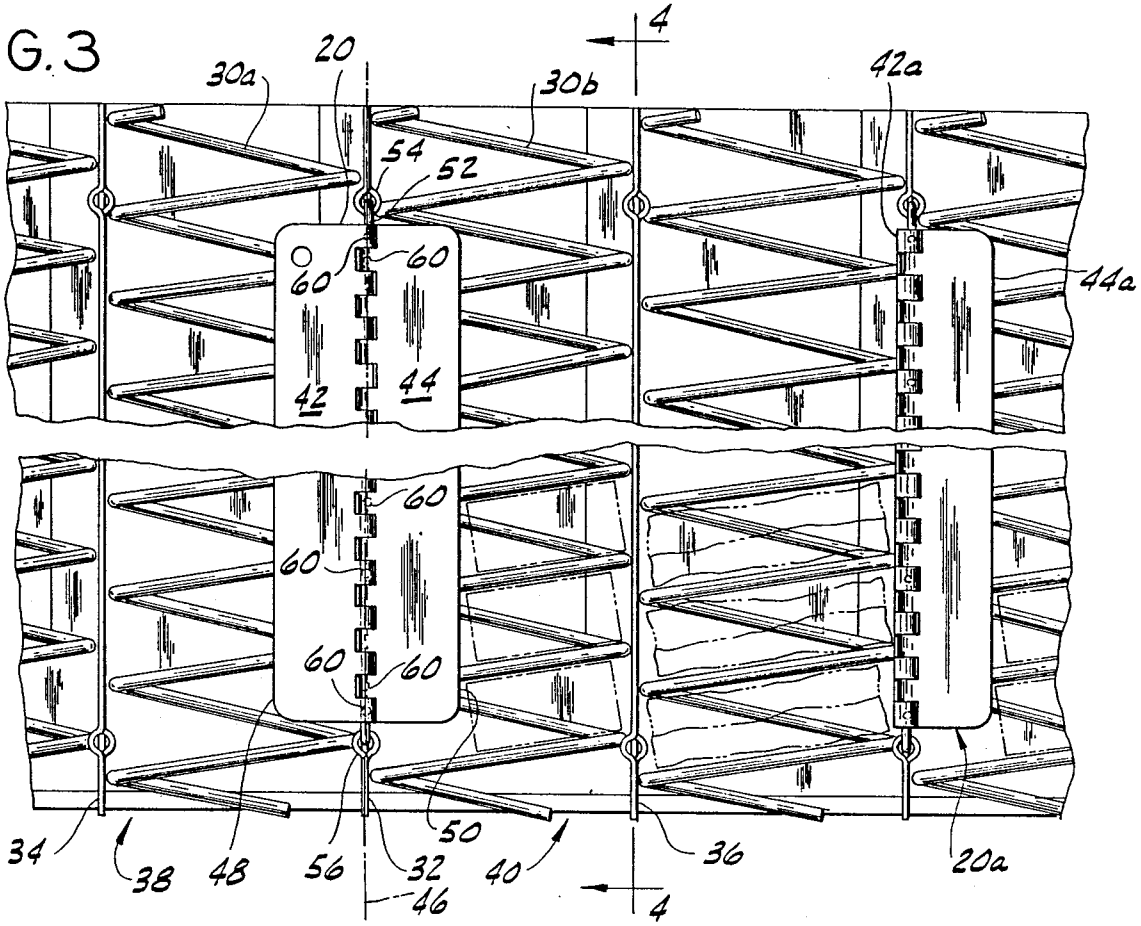
FIG. 3 is a top view showing the article alignment units connected to the partitions.

Referring to FIGS. 2 and 3, a generally vertical central partition 32 is positioned between first and second helices 30*a* and 30*b*. The central partition 32 has a top edge margin 32*m* (shown in FIG. 4) extending substantially the length of the helices. First and second generally vertical outer partitions 34 and 36 are positioned on opposite sides of the helices 30*a* and 30*b*. A first article compartment 38 is defined between the central partition 32 and the first outer partition 34, and a second article compartment 40 is defined between the central partition 32 and the second outer partition 36. The first compartment 38 contains the first helix 30*a* and the second compartment 40 contains the second helix 30*b*.

Figure 4:
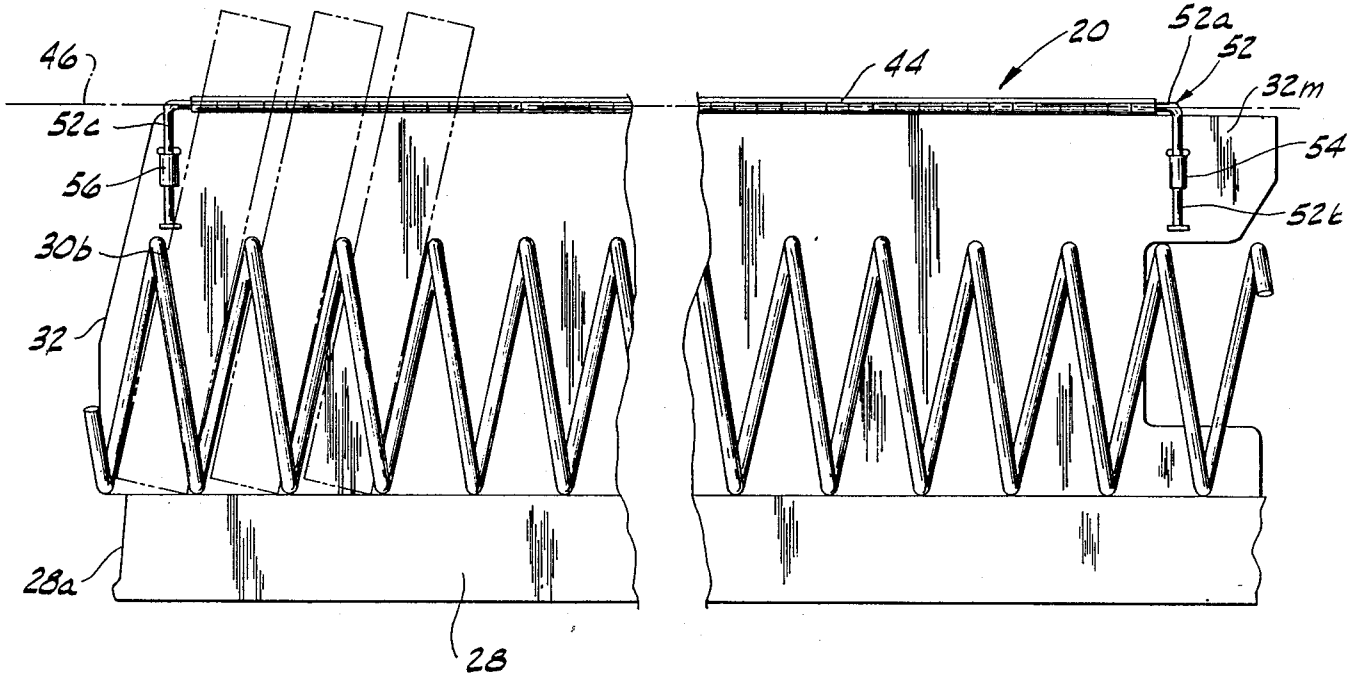
FIG. 4 is a cross-sectional view taken along the plane of line 4—4 of FIG. 3 showing the connection of one of the article alignment units to one of the partitions.

In general, the article alignment unit 20 comprises first and second elongate guide members 42 and 44 Although FIGS. 2–4 show a second article alignment unit 20*a* having first and second elongate guide members 42*a* and 44*a*, to simplify the description only unit 20 will be described in detail herein. However, it is to be understood that the construction of unit 20*a* is similar to that of unit 20. The first and second guide members 42 and 44 are hingedly connected together and adapted for independently pivoting about a common axis of rotation 46 which is generally parallel with and adjacent to the top edge margin 32*m* of central partition 32. The first guide member 42 defines a first guide surface 48 which is varyingly positionable by pivoting guide member 42 about the pivot axis 46. Pivoting first guide member 42 down and against central partition 32 to a generally vertical position maximizes the effective width of the article compartment (i.e., maximizes the distance between the first guide surface 48 and first outer partition 42) to accommodate relatively wide articles of product within compartment 38. Pivoting first guide member 42 upward to a generally horizontal position above helix 30*a* minimizes the effective width of the article compartment to accommodate relatively narrow articles of product within compartment 38. Preferably, guide member 42 is pivoted to a position in which the effective width is only slightly greater than the width of articles within compartment 38 so that lateral movement of the articles extending above helix 30*a* is restricted without causing the articles to jam within compartment 38. The second guide member 44 defines a second guide surface 50 which is varyingly positionable by pivoting guide member 44 about axis 46. Pivoting guide member 44 down and against central partition 32 maximizes the effective width for articles within compartment 40 and pivoting guide member 44 upward to a generally horizontal position above helix 30*b* minimizes the effective width for articles within compartment 40. Thus the position of guide member 44 and guide surface 50 is variable to restrict lateral movement of articles extending above helix 30*b* within compartment 40.

Reference is now made to FIGS. 3 and 4 which show guide members 42 and 44 being releasably attached to the top edge margin 32*m*. Guide members 42 and 44 pivot on and are secured together by a hinge pin 52. The hinge pin 52 comprises an elongate portion 52*a*, and rear and forward end portions 52*b* and 52*c*. The end portions 52*b* and 52*c* extend downwardly of the elongate portion 52*a* and are adapted to mate with rear and forward generally vertical sleeves 54 and 56, respectively, fixed adjacent to opposite ends of the central partition 32. The guide members 42 and 44 are releasably secured to the partition by sliding end portions 52*b* and 52*c* downward into sleeves 54 and 56. Guide members 42 and 44 are removed from partition 38 by sliding end portions 52*b* and 52*c* upward and out of sleeves 54 and 56. Thus, end portions 52*b* and 52*c* and sleeves 54 and 56 constitute means for releasably attaching and means for slidably attaching guide members 42 and 44 to top edge margin 32*m* of partition 32.

As shown in FIGS. 2 and 3, additional sleeves (designated generally as 58) are formed in partitions 34 and 36. The additional sleeves 58 permit a user to remove guide members 42 and 44 from partition 38 and secure them to partition 34 or partition 36 to vary the effective widths of the article compartments separated by those partitions. Preferably, all the partitions in the vending machine 22 are adapted to receive guide members so that the effective width of each article compartment is capable of being varied. Having a vending machine with each partition being adapted to receive guide members enables a user to change the location of wide and narrow articles in the vending machine without the need of having guide members on all partitions simultaneously. For example, a user who desires to place two aligned rows of narrow articles within adjacent compartments could change the location of the rows to either an upper or lower tray by changing the location of a single set of guide members. Thus, the location within the machine of articles to be dispensed can be varied.

Referring to FIG. 3, the guide members 42 and 44 frictionally engage the elongate portion 52*a* of hinge pin 52 by dimples 60 in the guide members 42 and 44. The dimples push against the elongate portion 52*a* of hinge pin 52 to create a friction interference between the guide members and hinge pin. Such friction interference causes each guide member to stay in the position to which it is pivoted.

In operation, articles to be dispensed are placed within an article compartment. The guide member within the compartment is pivoted upward and toward the articles to reduce the effective width of the compartment for restricting lateral movement of the articles. Since the guide member takes up little room when in its vertical position, the compartment can accommodate articles nearly as wide as the compartment. Conversely, since the effective width is substantially decreased when the guide member is pivoted to its horizontal position, the compartment can accommodate narrow articles. Since guide members 42 and 44 are hinged together, the article alignment unit 20 simultaneously varies the effective width of two adjacent compartments 38, 40. The releasability of the alignment unit 20 from partition 32 enables a user to quickly move unit 20 to another partition or remove it from the vending machine 22 altogether. Additionally, unit 20 is of simple and inexpensive construction and is compact for easy storage and handling.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An article dispensing unit, adapted for use in a vending machine comprising a cabinet having a rear and front, the article dispensing unit comprising at least one tray carrying at least two dispensing helices adapted for extending side-by-side from rear to front of the cabinet with each helix being selectively driven for advancing articles to be dispensed placed on the tray between convolutions of the helix, a generally vertical central partition between the two helices and having a top edge margin extending substantially the length of the helices, and first and second generally vertical outer partitions on opposite sides of the two helices with first and second article compartments being defined between the central partition and the first and second outer partitions, respectively, each compartment containing one of the helices, and an article alignment unit comprising a first elongate guide member pivotable about an axis parallel with and adjacent to the top edge margin of the central partition and external of the helix, the first guide member defining a first guide surface which is varyingly positionable by pivoting the first guide member about the pivot axis from a generally vertical position adjacent the central partition to a position extending toward the first outer partition and above the helix of the first compartment for restricting lateral movement of articles extending above the helix within the first compartment.

2. An article dispensing unit as set forth in claim 1 further comprising means for releasably attaching the first guide member to the top edge margin of the central partition.

3. An article dispensing unit as set forth in claim 2 wherein the attaching means comprises means for slidably attaching the first guide member to the top edge margin of the central partition.

4. An article dispensing unit as set forth in claim 1 wherein the article alignment unit further comprises a second guide member adapted for pivoting about the pivot axis of the first guide member, the second guide member defining a second guide surface which is varyingly positionable by pivoting the second guide member about the pivot axis from a generally vertical position adjacent the central partition to a position extending toward the second outer partition and above the helix in the second compartment for restricting lateral movement of articles extending above the helix within the second compartment.

5. An article alignment unit, adapted for use in a vending machine comprising a cabinet having a rear and front, at least one tray within the cabinet carrying at least two dispensing helices extending side-by-side from rear to front of the cabinet with each helix being selectively driven for advancing articles to be dispensed placed on the tray between convolutions of the helix, a generally vertical central partition between the two helices and having a top edge margin extending substantially the length of the helices, and first and second generally vertical outer partitions on opposite sides of the two helices with first and second article compartments being defined between the central partition and the first and second outer partitions, respectively, each compartment containing one of the helices, the article alignment unit comprising first and second elongate guide members hingedly connected together and adapted for independently pivoting about a common axis parallel with and adjacent to the top edge margin of the central partition, the first guide member defining a first guide surface which is varyingly positionable by pivoting the first guide member about the pivot axis from a generally vertical position adjacent the central partition to a position extending toward the first outer partition and above the corresponding helix for restricting lateral movement of articles extending above the helix within the first compartment, the second guide member defining a second guide surface which is varyingly positionable by pivoting the second guide member about the pivot axis from a generally vertical position adjacent the central partition to a position extending toward the second outer partition and above the corresponding helix for restricting lateral movement of articles extending above the helix within the second compartment.

6. An article alignment unit as set forth in claim 5 further comprising means for releasably attaching the guide members to the top edge margin of the central partition.

7. An article alignment unit as set forth in claim 6 wherein the attaching means comprises means for slidably attaching the guide members to the top edge margin of the central partition.

8. An article alignment unit as set forth in claim 7 wherein the guide members both pivot on a hinge pin having rear and forward end portions extending downward of the guide members, and wherein the slidable attaching means comprises rear and forward generally vertical sleeves fixed to the central partition and adapted to slidably receive the rear and forward end portions, respectively.

9. An article alignment unit as set forth in claim 5 wherein the guide members both pivot on a common hinge pin which is fixed relative to the central partition, and wherein the guide members frictionally engage the hinge pin so that the first guide member remains in any position to which it is pivoted and the second guide member remains in any position to which it is pivoted.

10. An article alignment unit, adapted for use in a vending machine comprising a cabinet having a rear and front, at least one tray within the cabinet carrying at least two dispensing helices extending side-by-side from rear to front of the cabinet with each helix being selectively driven for advancing articles to be dispensed placed on the tray between convolutions of the helix, a generally vertical central partition between the two helices and having a top edge margin extending substantially the length of the helices, and first and second generally vertical outer partitions on opposite sides of the two helices with first and second article compartments being defined between the central partition and the first and second outer partitions, respectively, each compartment containing one of the helices, the article alignment unit comprising a first elongate guide member adapted for pivoting about an axis parallel with and adjacent to the top edge margin of the central partition, a hinge pin upon which the first guide member pivots having rear and forward end portions extending downwardly of the first guide member, and means for releasably and slidably attaching the first guide member to the top edge margin of the central partition, the attaching means comprising rear and forward generally vertical sleeves fixed to the central partition and adapted for slidably receiving the rear and forward end portions, respectively, the first guide member defining a first guide surface which is varyingly positionable by pivoting the first guide member about the pivot axis from a generally vertical position adjacent the central partition to a position extending toward the first outer partition and above the helix of the first compartment for restricting lateral movement of articles extending above the helix within the first compartment.

11. An article alignment unit as set forth in claim 10 wherein the first guide member frictionally engages the hinge pin so that the first guide member remains in any position to which it is pivoted.

* * * * *